US008142227B1

(12) United States Patent
Kuo

(10) Patent No.: US 8,142,227 B1
(45) Date of Patent: Mar. 27, 2012

(54) MULTIFUNCTIONAL BASE FOR ENERGY SAVING LAMPS

(76) Inventor: Fang Puo Kuo, Taipei (TW)

( * ) Notice: Subject to any disclaimer, the term of this patent is extended or adjusted under 35 U.S.C. 154(b) by 0 days.

(21) Appl. No.: 13/177,120

(22) Filed: Jul. 6, 2011

(51) Int. Cl.
*H01J 5/50* (2006.01)

(52) U.S. Cl. ..... 439/611

(58) Field of Classification Search ..... 439/611–619, 439/266, 300

See application file for complete search history.

(56) References Cited

U.S. PATENT DOCUMENTS 4,628,421 A * 12/1986 Saar ..... 362/238
7,892,031 B1 * 2/2011 Mostoller et al. ..... 439/611
2009/0196034 A1 * 8/2009 Gherardini et al. ..... 362/235
* cited by examiner

*Primary Examiner* — Tulsidas C Patel
*Assistant Examiner* — Phuongchi Nguyen
(74) *Attorney, Agent, or Firm* — Rabin & Berdo, P.C.

(57) ABSTRACT

A multifunctional base for energy saving lamps includes a base body defining an inner receiving space and provided with a bottom through hole and a side opening; a circuit board vertically mounted in the receiving space of the base body and having a power conversion circuit provided thereon; and a set of spring conductive strips including at least a first and a second spring conductive strip. The first spring conductive strip has an end electrically connected to the circuit board and another end protruded from the base body via the bottom through hole; and the second spring conductive strip has an end electrically connected to the circuit board and another end protruded from the base body via the side opening. The first and second spring conductive strips act to enable increased contact tightness between the lamp base and a lamp socket.

4 Claims, 9 Drawing Sheets

MULTIFUNCTIONAL BASE FOR ENERGY SAVING LAMPS

FIELD OF THE INVENTION

The present invention relates to a lamp base for screwing into a screw-type lamp socket, and more particularly to a multifunctional base for energy saving lamps that consolidates the whole circuitry from power line-in to power conversion circuit all in one assembly to eliminate soldering wires from screw lamp head, and can be easily manufactured to save assembly time and material cost, ease workmanship skill requirement and improve product reliability.

BACKGROUND OF THE INVENTION

The incandescent light bulb has quickly become the most widely applied lighting device in the world since it was invented. The incandescent light bulb is easy to install and can be conveniently powered with either alternating current (AC) or direct current (DC). Therefore, the incandescent light bulb and the screw-type lamp socket therefor are available almost everywhere in the world.

However, due to the progress in the scientific and technological fields, a variety of new and energy-saving lighting devices, such as hot cathode fluorescent lamp (HCFL), cold cathode fluorescent lamp (CCFL) and light-emitting-diode (LED) lamp, has been constantly developed and introduced into market in response to the requirement for energy saving in the modern society. Compared to the new types of energy-saving lighting devices, the conventional incandescent light bulb has high power consumption and low luminous efficiency and fails to satisfy the energy saving requirement.

The newly developed lighting devices respectively have uniquely designed lamp base and socket, and use different and incompatible voltages and frequencies. For instance, the LED lamp uses 3~5V DC while the CCFL uses current having a voltage as high as several hundred volts. Therefore, these new lighting devices could not be directly used with the conventional screw-type lamp socket that is still used by most people.

According to one of the ways for installing various new types of energy-saving lighting devices on the conventional screw-type lamp socket, a circuit board for regulating voltage and current and a light-emitting element are together packaged in a lamp base. For example, as shown in FIG. 1, to mount a compact fluorescent lamp (CFL) 11 on a general screw-type lamp socket, the tube of the CFL 11 is first formed into a circular or a helical shape and then sealed in a lamp shade 12, and voltage transforming and control circuits 10 are mounted inside a lamp base to thereby form an energy saving lamp that can be conveniently fitted in the existing screw-type lamp socket and has low power consumption. In this type of energy saving lamp, the circuit board is transversely located above the light-emitting element of the lighting device. Heat generated by the light-emitting element is stopped by the transversely mounted circuit board from dissipating into environment outside the lamp base. Therefore, the energy saving lamp as shown in FIG. 1 actually has relatively low heat dissipation efficiency. Further, since an additional procedure is required to weld the circuit board to the lamp base, more time and labor is needed to produce the conventional energy saving lamp while the production efficiency and reliability thereof is reduced.

To reduce the manufacturing cost of the energy saving lamp, US Patent Publication No. 2008/0174224 discloses an improved lamp structure that can be manufactured with simplified procedures to reduce the manufacturing cost and allows convenient inspection and repair of the lamp. For this purpose, the lamp structure includes a lamp base having a base body and a circuit board. The circuit board is fitted in the base body with an electrically conductive layer on lateral edges of the circuit board exposed from openings provided on the base body. Therefore, the lamp structure is simple and easy to produce.

However, the electrically conductive layer is a thin film structure coated on the lateral edges of the circuit board, and accordingly, has low mechanical strength and electrical connection performance compared to the conventional metal-made lamp base. Moreover, to coat the electrically conductive layer on the lateral edges of the circuit board, complicated via plating process is needed and the circuit board must be carefully and precisely cut. These procedures adversely reduce the benefit from the simplified manufacturing procedures.

SUMMARY OF THE INVENTION

It is therefore a primary object of the present invention to provide a multifunctional base for energy saving lamps that is easy to manufacture, provides good heat dissipation efficiency, has high mechanical strength, and enables good electrical connection.

To achieve the above and other objects, the multifunctional base for energy saving lamps according to the present invention includes a base body, a circuit board, at least one first spring conductive strip, and at least one second spring conductive strip. The base body defines an inner receiving space, and is provided at a bottom with a through hole and on a wall portion with a side opening. The circuit board is vertically mounted in the receiving space of the base body, and has a power conversion, ballast circuit or any functional circuit elements provided thereon. The first spring conductive strip has an end electrically connected to the circuit board and another end protruded from the base body via the bottom through hole. The second spring conductive strip has an end electrically connected to the circuit board and another end protruded from the base body via the side opening.

In a preferred embodiment, the base body is provided with external screw threads.

In another preferred embodiment, the circuit board further has an adjustment mechanism movably connected thereto. The adjustment mechanism includes a first end pressed against the first spring conductive strip, a second end pressed against the second spring conductive strip, and a link extended between the first and second ends to move the two ends at the same time.

In a further preferred embodiment, the base body is assembled from a first half and a second half, and the inner receiving space is defined between the first and second halves to have an open top.

In a still further preferred embodiment, the link is in the form of a long bar with bends, and has a middle portion serving as a pivot shaft.

The present invention is characterized by the first and the second spring conductive strip that protrude from the bottom and the wall portion of the base body, respectively, to enable increased contact tightness between the lamp base and a lamp socket. And, compared to the lamp head disclosed in US Patent Publication No. 2008/0174224, which has an electrical conductive layer coated on lateral edges of the circuit board, the spring conductive strips according to the present invention provide increased wear resistance and mechanical strength.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
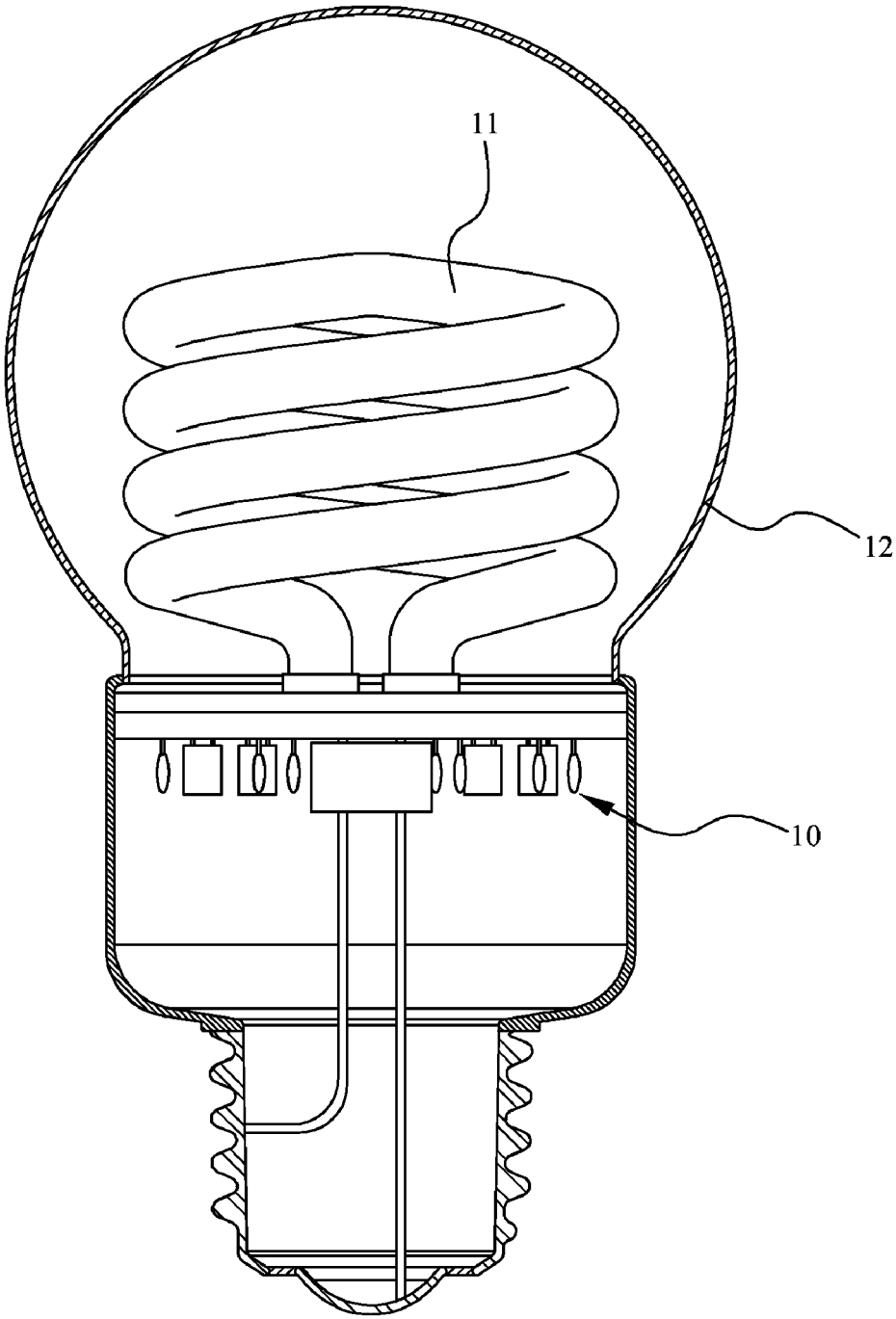
FIG. 1 is a sectional view of a conventional compact fluorescent energy saving lamp.

The present invention will now be described with some preferred embodiments thereof and with reference to the accompanying drawings. For the purpose of easy to understand, elements that are the same in the preferred embodiments are denoted by the same reference numerals.

Figure 2:
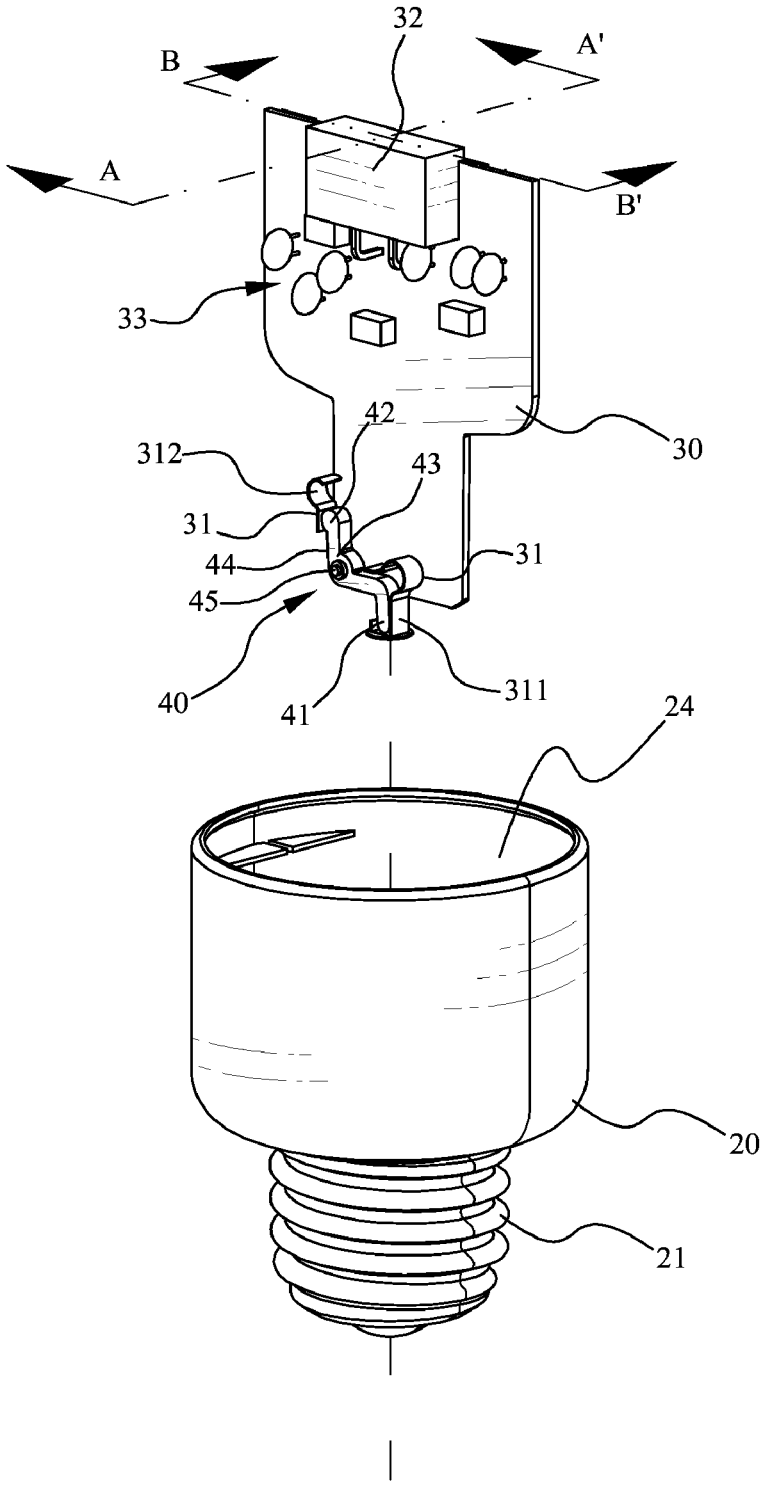
FIG. 2 is an exploded perspective view of a multifunctional base for energy saving lamps according to a first preferred embodiment of the present invention.
Figure 3:
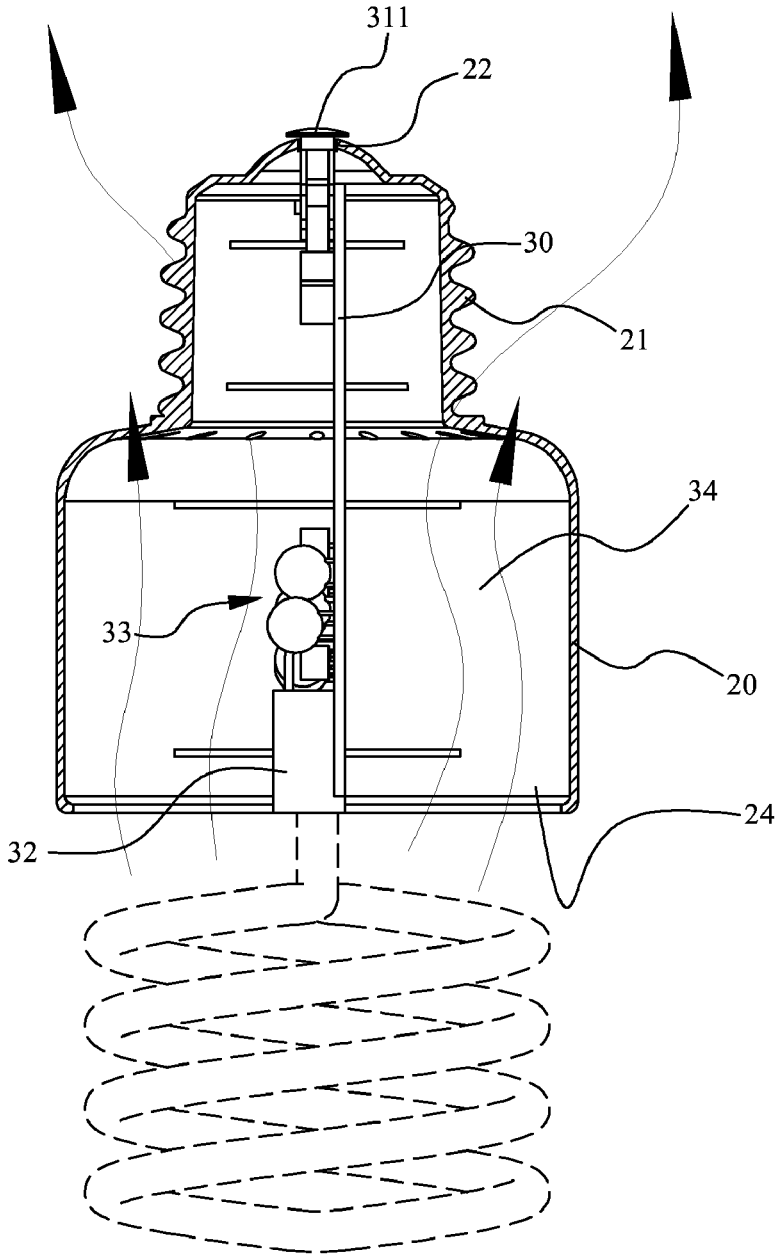
FIG. 3 is a sectional view taken along line A-A' of FIG. 2 showing the manner in which lamp emitted heat is dissipated from the multifunctional base for energy saving lamps according to the present invention.
Figure 4:
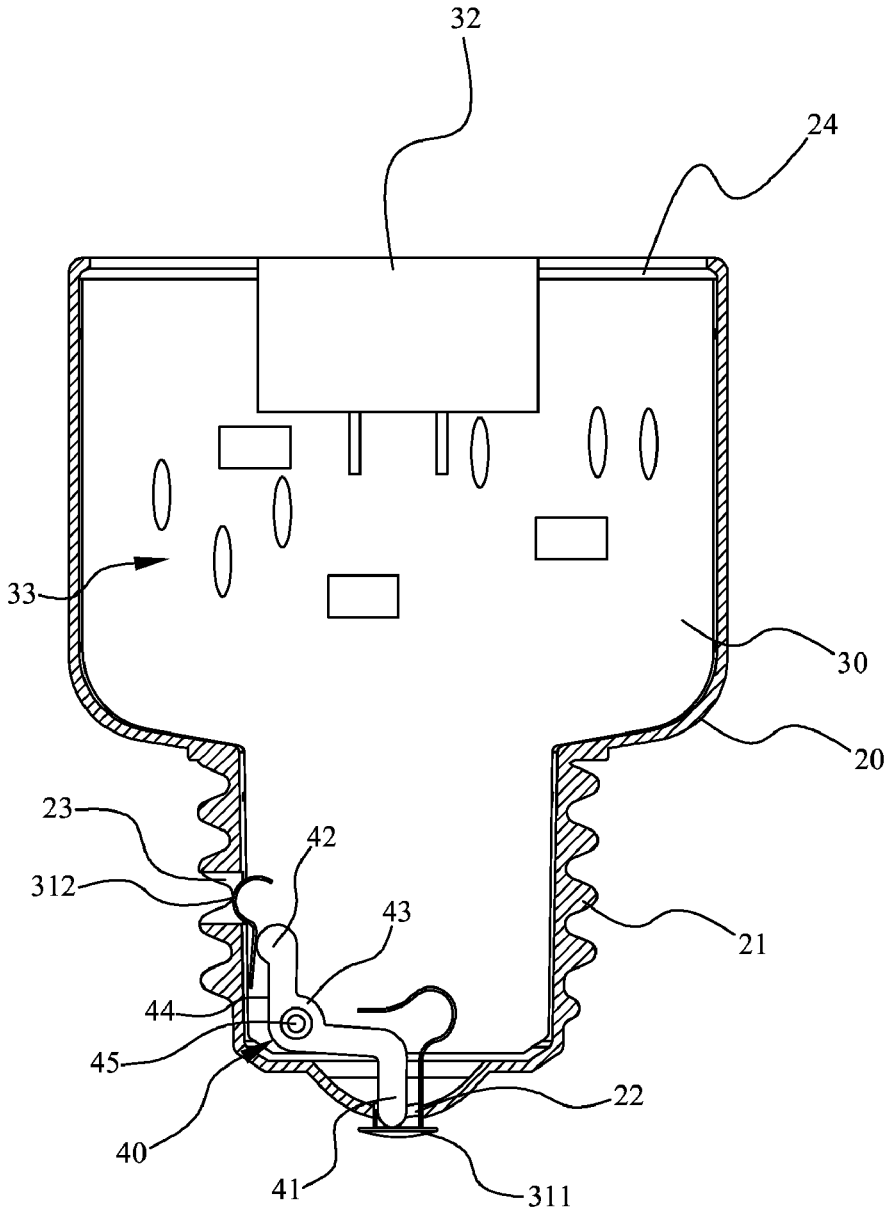
FIG. 4 is a sectional view taken along line B-B' of FIG. 2.

Please refer to FIGS. 2 to 4, in which a multifunctional base for energy saving lamps according to a first preferred embodiment of the present invention is shown. For the purpose of conciseness, the multifunctional base for energy saving lamps according to the present invention is also briefly referred to as "lamp base" herein. As shown, the lamp base in the first preferred embodiment includes a base body 20 and a circuit board 30 mounted in the base body 20. The base body 20 is provided on an outer surface with external screw threads 21 for screwing into a screw-type lamp socket, at a bottom with a through hole 22, and on at least one side of a wall portion with a side opening 23. The base body 20 defines an internal receiving space 24, in which the circuit board 30 is vertically mounted. On the circuit board 30, there is provided at least one power outlet 32 and one power conversion circuit 33. The power outlet 32 is variable in type to match different lighting devices. By vertically mounting the circuit board 30 in the base body 20, two hot-air passages 34 are formed in the receiving space 24 separately at a front side and a reverse side of the circuit board 30. Via the hot-air passages 34, waste heat emitted by a lamp connected to the lamp base is dissipated into ambient air. The circuit board 30 is connected to a set of spring conductive strips 31, which respectively have an end electrically connected to the circuit board 30 and another end suspended in the receiving space 24. In the illustrated first preferred embodiment, the set of spring conductive strips 31 includes a first spring conductive strip 311 and a second spring conductive strip 312. The first spring conductive strip 311 has an end electrically connected to the circuit board 30 and another end protruded from the bottom of the base body 20 via the through hole 22; and the second spring conductive strip 312 has an end electrically connected to the circuit board 30 and another end protruded from the base body 20 via the side opening 23.

As can be seen from FIGS. 2 and 4, the circuit board 30 further has an adjustment mechanism 40 movably connected thereto. The adjustment mechanism 40 includes a first end 41 pressed against the first spring conductive strip 311, a second end 42 pressed against the second spring conductive strip 312, and a link 43 extended between the first and the second end 41, 42 to move them at the same time.

Figure 5:
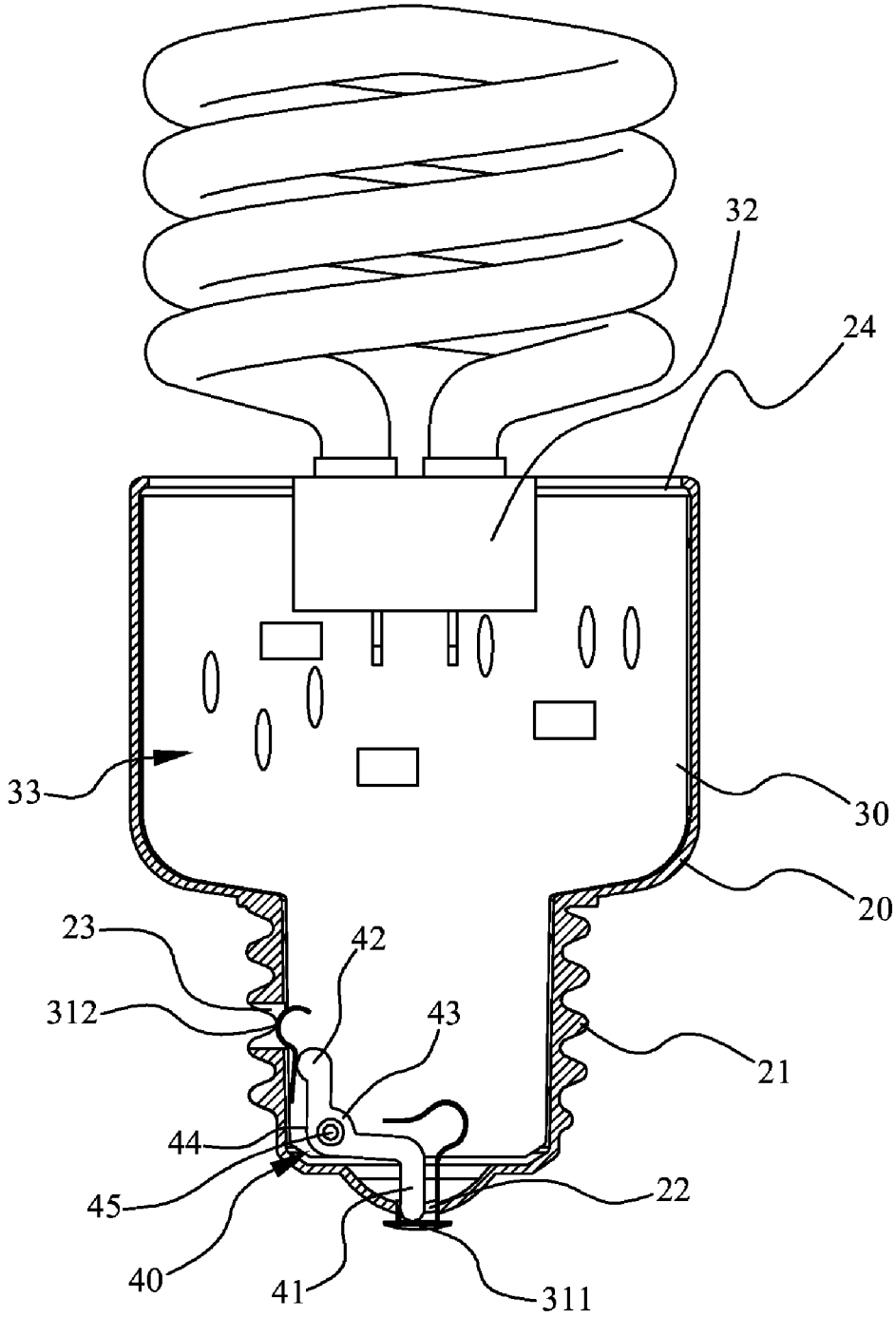
FIG. 5 shows the multifunctional base for energy saving lamps according to the present invention with a compact fluorescent lamp connected thereto.

Please refer to FIG. 5. In the illustrated first preferred embodiment, the power outlet 32 can be implemented as a cold cathode fluorescent lamp (CCFL) connector for a spiral-type CCFL to connect thereto. With the power conversion circuit 33, AC grid electricity can be directly converted into the high-voltage current required by the CCFL. Therefore, the multifunctional base for energy saving lamps according to the present invention is easy to produce and convenient for use.

Figure 6:
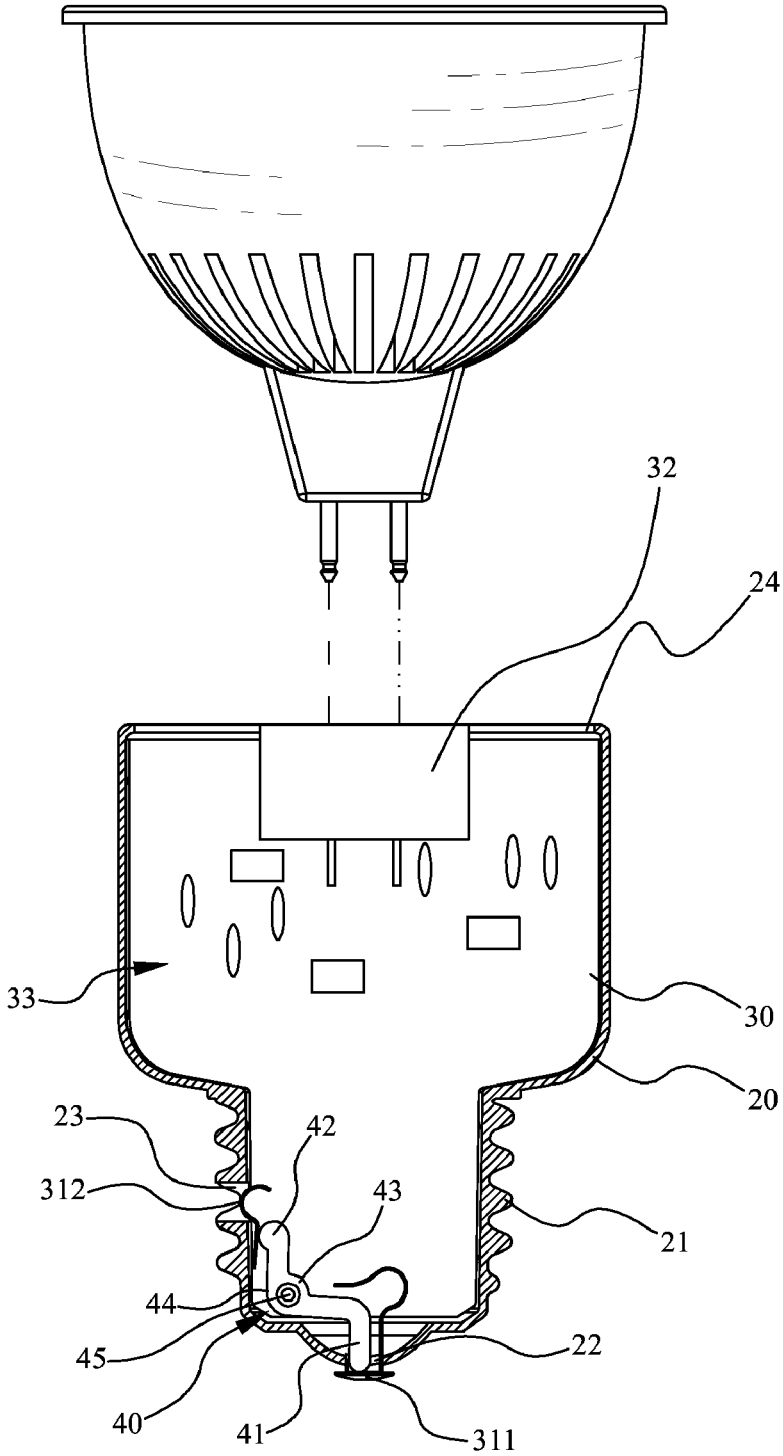
FIG. 6 shows the connection of an MR (multifaceted reflector) LED lamp to the multifunctional base of the present invention.

FIG. 6 shows the power outlet 32 for the lamp base according to the first preferred embodiment of the present invention is implemented as a receptacle for a conventional MR (multifaceted reflector) LED lamp, so that an MR LED lamp can be detachably connected to the multifunctional lamp base of the present invention. When the MR LED lamp is damaged or no longer usable, it can be replaced alone without the need of discarding the lamp base and vice versa. In this manner, it is able to save valuable resources and achieve the effect of environmental protection.

Please refer back to FIGS. 2 and 4. In the illustrated first preferred embodiment of the lamp base, the link 43 can be implemented in different shapes, including but not limited to a long bar 44 with bends. The bent long bar 44 has a middle pivot shaft 45, via which the bent long bar 44 is pivotally connected to the circuit board 30, such that one of two opposite ends of the bent long bar 44 forms the first end 41 pressed against the first spring conductive strip 311 and the other end of the bent long bar 44 forms the second end 42 pressed against the second spring conductive strip 312. Thus, when the first spring conductive strip 311 is compressed by an external force, the bent long bar 44 is brought by the compressed first spring conductive strip 311 to turn about the middle pivot shaft 45, so that the second end 42 is displaced and forces the second spring conductive strip 312 to protrude from the base body 20 via the side opening 23. While the present invention has been described with the link 43 configured as a bent long bar 44, it is understood the bent long bar 44 is only illustrative to enable easy and clear description of the present invention and not intended to limit the form of the link 43 in any way. In other words, the link 43 can be differently designed according to the actual application of the lamp base.

Figure 7:
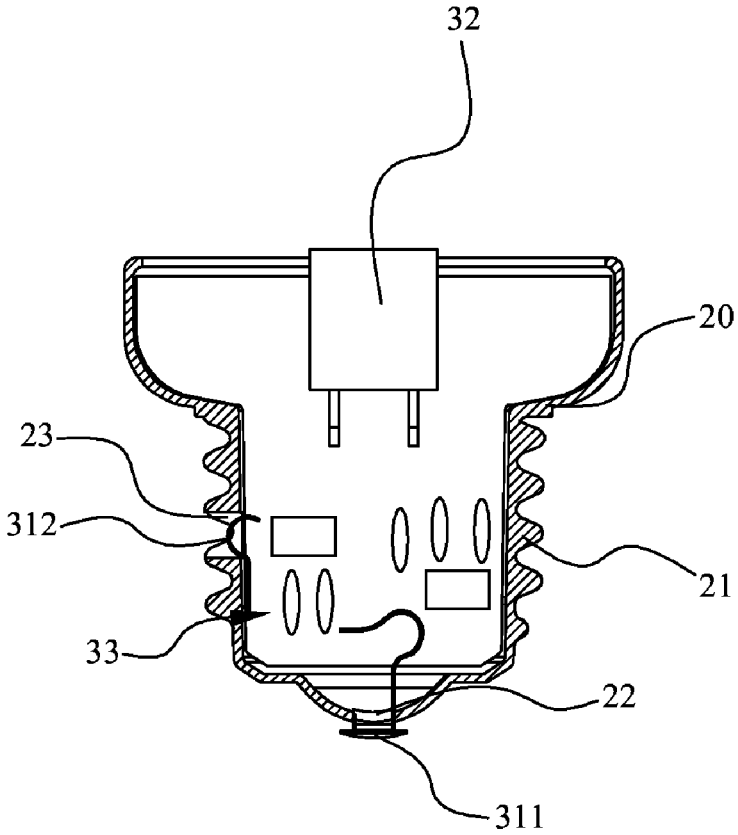
FIG. 7 is a sectional view of a multifunctional base for energy saving lamps according to a second preferred embodiment of the present invention.

FIG. 7 is a sectional view of a multifunctional base for energy saving lamps according to a second preferred embodiment of the present invention. In the second embodiment, the lamp base has a relatively small size compared to that in the first embodiment. In such a size-reduced lamp base, the first and the second spring conductive strip 311, 312 respectively have an elastic restoring force sufficient to ensure good electric contact between the lamp base and the lamp socket, even if the above-mentioned adjustment mechanism 40 is omitted. Therefore, the second preferred embodiment illustrated in FIG. 7 does not include the adjustment mechanism 40.

Figure 8:
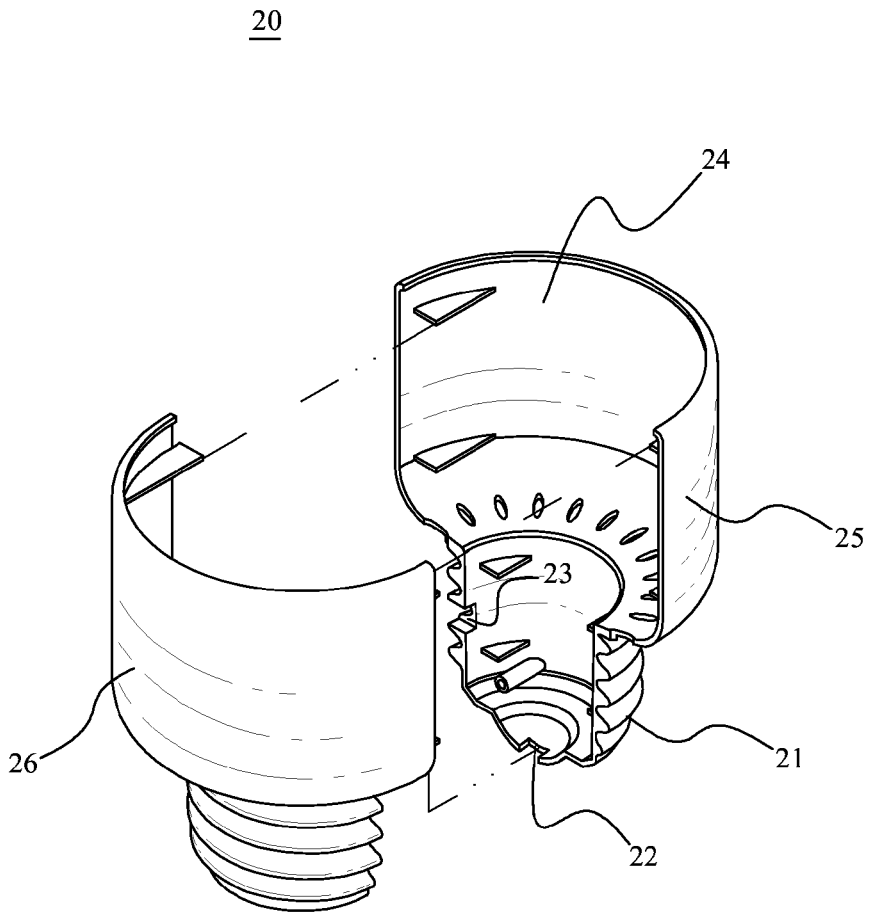
FIG. 8 is an exploded perspective view of a multifunctional base for energy saving lamps according to a third preferred embodiment of the present invention.

FIG. 8 is an exploded perspective view of a multifunctional base for energy saving lamps according to a third preferred embodiment of the present invention. Please refer to FIGS. 2 and 8 at the same time. In the third embodiment, the base body 20 is assembled from a first half 25 and a second half 26, and the receiving space 24 is defined between the first and the second half 25, 26 and has an open top. With the base body 20 assembled from two halves 25, 26, the circuit board 30, the set of spring conductive strips 31 and the adjustment mechanism 40 can be more easily mounted in the receiving space 24.

Figure 9:
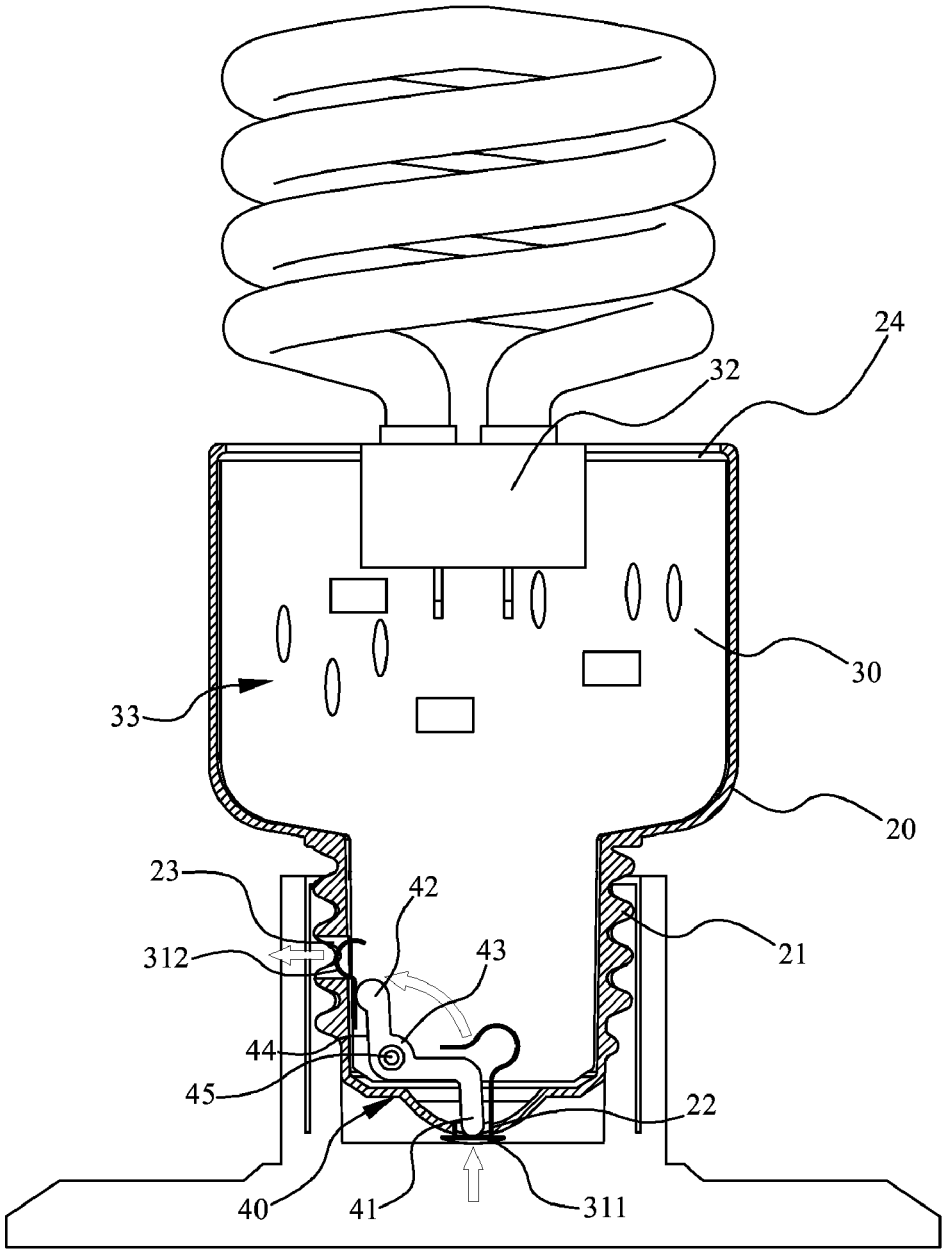
FIG. 9 is a sectional view showing a second spring conductive strip in the multifunctional base for energy saving lamps according to the present invention is driven by an adjustment mechanism to protrude from the lamp base when the latter is screwed into a lamp socket.

Please refer to FIG. 9. The multifunctional base for energy saving lamps according to the present invention can be directly screwed into a general screw-type lamp socket, just like the conventional incandescent light bulb. When the lamp base is fully screwed into the lamp socket, the first spring conductive strip 311 is pushed by an inner bottom of the lamp socket to thereby move the link 43 upward. At this point, the link 43 would turn about the pivot shaft 45 to thereby drive the second spring conductive strip 312 to protrude from the base body 20 via the side opening 23, securing the contact tightness between the lamp base and the lamp socket.

In conclusion, the first and the second spring conductive strip act to increase the contact tightness between the lamp base and the lamp socket when the lamp base of the present invention is screwed into the conventional screw-type lamp socket. And, compared to the electrically conducting layer coated on lateral edges of the circuit board as disclosed in US Patent Publication No. 2008/0174224, the spring conductive strips according to the present invention apparently provide better wear resistance and mechanical strength.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A multifunctional lamp base, comprising:

a base body internally defining a receiving space, and being provided at a bottom with a through hole and on at least one side of a wall portion with a side opening;

a circuit board being vertically mounted in the receiving space of the base body and having a power conversion circuit provided thereon;

at least one first spring conductive strip having an end electrically connected to the circuit board and another end protruded from the bottom of the base body via the through hole;

at least one second spring conductive strip having an end electrically connected to the circuit board and another end protruded from the base body via the side opening; and an adjustment mechanism having a link, the link being in the form of a long bar having bends and having a middle pivot shaft, via which the link is movably connected to the circuit board.

2. The multifunctional lamp base as claimed in claim 1, wherein the circuit board has the adjustment mechanism movably connected thereto; the adjustment mechanism having a first end and a second end, the link being extended between the first and the second end to move the two ends at the same time; the first end of the adjustment mechanism being pressed against the first spring conductive strip, and the second end of the adjustment mechanism being pressed against the second spring conductive strip.

3. The multifunctional lamp base as claimed in claim 1, wherein the base body is assembled from a first half and a second half, and the receiving space is defined between the first and the second half to have an open top.

4. The multifunctional lamp base as claimed in claim 1, wherein the base body is provided on an outer surface with external screw threads.

* * * * *